United States Patent [19]

Takeuchi et al.

[11] 4,066,450

[45] Jan. 3, 1978

[54] METAL BODY HAVING LARGE SURFACE AREA AND PROCESS FOR PRODUCING SAME

[75] Inventors: Masaharu Takeuchi; Isemi Igarashi, both of Nagoya; Tsuchio Bunda, Okazaki, all of Japan

[73] Assignee: Kabushiki Kaisha Toyota Cho Kenkyusho, Japan

[21] Appl. No.: 634,646

[22] Filed: Nov. 24, 1975

[30] Foreign Application Priority Data

Nov. 26, 1974 Japan ..... 49-136461

[51] Int. Cl.[2] ..... C22C 1/09

[52] U.S. Cl. ..... 75/229; 428/605; 75/DIG. 1

[58] Field of Search ..... 75/DIG. 1, 212, 229, 75/DIG. 10; 29/182.1, 182.3, 192 R, 192 CP, 419, 163.5 F, 163.5 R; 427/436, 216, 217; 228/178, 183, 258; 428/288, 605

[56] References Cited

U.S. PATENT DOCUMENTS

| | | | |
|---|---|---|---|
| 3,127,668 | 4/1964 | Troy | 75/DIG. 1 |
| 3,262,190 | 7/1966 | Rostoker et al. | 29/419 X |
| 3,469,297 | 9/1969 | Webber | 428/605 |
| 3,485,595 | 12/1969 | Kraft | 428/605 |
| 3,770,492 | 11/1973 | Schladitz | 29/419 X |

OTHER PUBLICATIONS

Severdenko, V.P. et al., Metals Abs. 62–0366, Abstructing Fizikia i Khim. Obrabot. Mat. Mar–Apr. 1975, pp. 107–111.

*Primary Examiner*—Richard E. Schafer
*Attorney, Agent, or Firm*—Berman, Aisenberg & Platt

[57] ABSTRACT

A metal body having a very large surface area and high porosity, useful as a gasoline vaporizer, a heat exchanger for automobiles, a catalyst or catalyst carrier, a filter, or the like, and composed of a plurality of metal fibers which are entangled with one another to form a bed or stratum, the metal fibers being coated with a metal in such manner that the stratum provides rough and complex surfaces with cracks and irregularities. The invention also includes a process for making said metal body including the steps of entangling metal fibers to form a bed, placing the bed of fibers in contact with a coating metal, heating the fiber bed and coating metal so as to wet the fibers with molten coating metal, and cooling.

17 Claims, 8 Drawing Figures

X 91 300μ

X 91 300μ

X 264 100μ

X 528 50μ

X 91 300μ

X91 300μ

X 264 100μ

X528 50μ

METAL BODY HAVING LARGE SURFACE AREA AND PROCESS FOR PRODUCING SAME

FIELD OF THE INVENTION

This invention relates to a metal body having a large surface area of high porosity, useful as a gasoline vaporizer, catalyst carrier, heat exchanger, filter or the like, and to a process for producing said metal body.

BACKGROUND OF THE INVENTION

Vaporizers for gasoline and the like, catalysts, catalyst carriers, filters, or heat exchangers for use in a motor vehicle should provide not only large surface areas but also should be highly porous.

The present invention is directed to providing a metal body which meets the aforesaid requirements. According to one aspect of the present invention, there is provided a metal body having a large surface area of high porosity, which contains a plurality of metal fibers that are entangled with one another in the form of a bed or stratum, the aforesaid metal fibers being coated with aluminum or an aluminum alloy, said surface area, being rough and complex with cracks, irregularities and flake or plate-shaped portions.

The metal body according to the present invention provides porosity and includes voids of varying size, because a plurality of the metal fibers in the stratum are superposed on one another either in random directions or in a given direction. The metal fibers are coated with a metal in such manner as to produce complex, rough surfaces, so that the metal body provides an enormously large surface area. In addition, since the fiber coatings are of aluminum or an aluminum alloy having high heat conductivity, the metal body also provides high heat conductivity an excellent property required for the aforesaid use as a vaporizer. Furthermore, the surfaces of the fiber coatings are covered with aluminum oxide films, so that the metal body presents a surface area which has high corrosion resistance.

SUMMARY OF THE INVENTION

A primary object of the present invention is to provide a metal body having a very large surface area and high porosity, and useful as a vaporizer for gasoline, as a heat exchanger for an automobile, and as a catalyst or catalyst carrier, or the like.

Another object of the present invention is to provide a metal body of large surface area and high porosity, having the described uses and characteristics, wherein the metal body has at least one surface which is rough and complex in shape with cracks and irregularities.

A further object of the present invention is to provide a metal body having the above-described uses and characteristics, wherein at least one surface is formed of a plurality of metal fibers which are entangled with one another and are coated with a metal over the entire surfaces of the fibers.

Yet another object of the invention is to provide a metal body having the above described uses and characteristics and which is not only capable of use as a vaporizer for gasoline as a catalyst, catalyst carrier but also as a filter.

Still another object of the invention is to provide a process for producing a metal body having an extremely large surface area and very high porosity having the above described uses and characteristics.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several Figures, and in which:

FIGS. 1 and 2 are views illustrative of the first embodiment according to the present invention, in which FIG. 1 shows in exploded elevation the necessary sheets being assembled in one of the steps of a process for producing the metal body product, and FIG. 2 is a perspective view of a fabricated metal body according to the invention having a large surface area and secured on a base sheet;

DESCRIPTION OF THE PREFERRED EMBODIMENTS

Figure 1:
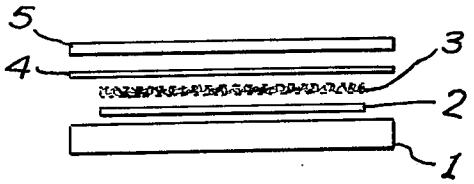

The metal fibers according to the present invention serve as a base or frame portion of the product metal body having a large surface area of high porosity. Metal fibers which may be employed in the present invention are those made of iron or an iron alloy such as iron-chromium, stainless steel, and the like, plus those made of tungsten, molybdenum or the like. Among these, iron and iron alloy are most preferable, because they can be closely bound with aluminum or an aluminum alloy serving as the fiber coating. Preferably, the diameter of the metal fibers should range from 20 $\mu$ to 500 $\mu$. Metal fibers, of less than 20 $\mu$ diameters fail to achieve the desired support function as a base or frame portion, while fiber diameters greater than 500 $\mu$ fail to provide a desired porosity for the surface area of the metal body. Metal filaments which have been produced by stretching a metal wire to a small diameter or a whisker may be employed as the aforesaid metal fibers. The aforesaid metal fibers are prepared by entangling a single filament having a considerable length, or a plurality of fibers with each other, in random directions, or in a given direction, to thereby form a spongy layer or layers which serve as the large surface area of the aforesaid metal body.

The coatings covering the metal fibers consist essentially of aluminum or an aluminum alloy. The aluminum alloy which may be used in the present invention is aluminum-copper, aluminum-manganese, aluminum-silicon alloys or the like. As shown in FIGS. 5*a* – *d*, the surfaces of the coating layers have a plurality of spaces, cracks, irregularities and flake or plateshaped portions, thus providing complex, rough surfaces. The aforesaid coating layers cover the entire surfaces of metal fibers. However, boundaries between the coating layers and the metal fibers may not necessarily be distinct and thus, as shown in embodiments which will be described later, atoms in both metals of the coating and the fibers may be diffused to each other and then both metals may be physically mixed or alloyed along those boundaries.

According to a second aspect of the present invention, there is provided a process for producing the aforesaid metal body having a large surface area and high porosity, in which one or more layers of metal fibers entangled with one another are placed in contacting relation on a coating metal member made of aluminum or an aluminum alloy, and then the metal fibers and coating metal member are heated in an non-oxidative atmosphere to a temperature not lower than the melting point of the aforesaid coating metal but lower than the melting point of the metal fibers. In this respect, the metal fibers have a melting point higher than that of the coating metal. (This process will be referred to as a first method of the invention, hereinafter.) Due to such heating, the coating metal is melted, and as a result the metal fibers which contact the molten coating metal are wetted by the molten metal, after which the metal fibers which have not contacted the coating metal at first become wet with the molten coating metal due to the wettability of the molten metal which creeps up over the surfaces of the metal fibers, so that the entire surfaces of the metal fibers get wet with the molten coating metal, eventually. After the entire surfaces of the metal fibers have been covered with the molten coating metal, the metal fibers are cooled, so that there is provided a metal body of a large surface area and high porosity which consists essentially of a bed of metal coated fibers having the aforesaid rough and complex surfaces.

Figure 5A:
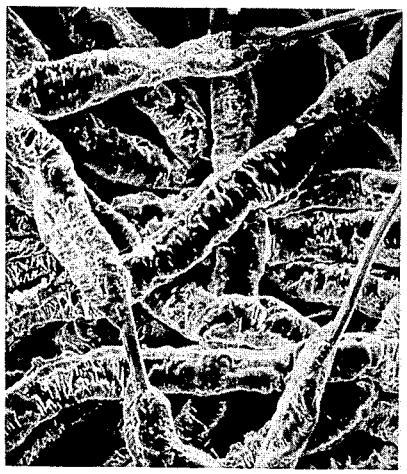
FIGS. 5*a* to *d* are secondary electron micrographs according to EPMA, of the cross sections of a metal body obtained according to the first embodiment in which a magnification of 91 is used for FIGS. 5*a* and *b*, a magnification of 264 for FIG. *c* and a magnification of 528 for FIG. 5*d*.

In the described first process, if the heating time is short enough to just cover the metal fibers with the molten coating metal, the boundaries between the metal fibers and the coating layers are relatively distinct, and the coating layers exhibit cracked and irregular surfaces, FIGS. 5*a* and *c*. On the other hand, if the aforesaid heating time is longer, the metal fibers react with the coating metal to alloy at only the boundaries of the fibers and coating layers resulting in vague boundaries, or if the heating time is still longer both the fiber metal and the coating metal react entirely with each other to form a uniform alloy in which the initial metal fibers disappear, and the coating layers exhibit flake or plate-shaped surfaces, FIGS. 5*b* and *d*.

The same metals as those described earlier may be used in this first method as the coating metal and metal fibers, respectively. The metal fibers serve as a support frame to maintain the shape of the metal body, which is in one or more layers, until the metal fibers are coated over their entire surfaces and the coated metal fibers are cooled.

For this reason, the melting point of the metal fibers should be higher than that of the coating metal and, in addition, the aforesaid heating should be carried out within a temperature range not lower than the melting point of the coating metal but lower than that of the metal fibers. It is preferable that, before bringing the metal fibers in contact with the coating metal, a stratum of the metal fibers is formed to a predetermined thickness and then heated to sintering temperature, thus the metal fibers are sintered and joined at the contacting points of the fibers, thereby providing a rigid frame for the metal body.

The aforesaid heating of the metal fibers and coating metal should be carried out in a non-oxidative atmosphere. If the heating is carried out in an oxidative atmosphere, the molten coating metal will be oxidized, during the time, in which the metal fibers are getting wet with the molten coating metal, so that the obtained metal body would have brittle coating layers.

According to a still another aspect of the present invention, there is provided a process, for producing a metal body having a large surface of high porosity which body is secured to a base member, in which a first metal consisting of aluminum, or an aluminum alloy, and a second metal consisting of copper, or a copper alloy, are used as coating metals, and the first metal is brought into contact with the second metal, after which metal fibers are placed in a stratum or layer on the second metal. The metal fibers should have a melting point higher than that of an aluminum-copper base coating alloy produced by the reaction of both the first and second coating metals during the heating step. The first and second coating metals plus the metal fibers are heated in a non-oxidative atmosphere at a temperature not lower than the melting point of the aforesaid aluminum copper base coating alloy and lower than that of the metal fibers, and as a result, a portion of the first metal and the second metal are melted to produce a molten aluminum-copper base coating alloy and the metal fibers get with the molten coating alloy to cover the entire surfaces thereof due to the wettability of the molten alloy creeping up over the surfaces of the metal fibers. The unalloyed other portion of the first metal remains as a base member for and is secured to the final metal body. (This will be referred to as a second method of the invention, hereinafter.) According to this second method, a metal body having a large surface area of high porosity secured to a base member is obtained.

Due to the aforesaid heating, one portion of the first metal member reacts with the second metal to provide an aluminum-copper base alloy, having a solid-liquid phase or a liquid phase. As in the first method of the invention, the metal fibers are coated by wetting with the molten aluminum-copper base alloy over their entire surfaces thereby to obtain a metal body in which a stratum of metal fibers are coated with essentially an aluminum-copper base alloy to form a metal body of large surface area having complex and rough surfaces. As is clear from the foregoing, the heating temperature should be such as to provide a liquid phase or a solid-liquid phase for the aluminum-copper base alloy produced from the first and second metals, i.e., a temperature, at which the aluminum-copper base coating alloy is melted. In practical application, the heating temperature should preferably be 20° C to 50° C higher than the eutectic temperature of the aluminum-copper alloy. Since the metal fibers contact the second metal having a melting point higher than that of the first metal, there is no possibility of the metal fibers being covered only with aluminum or an aluminum alloy, the first metal, as in the first method of the invention.

The boundaries between the metal fibers and the coating metal after heating in the second method of the invention are governed by the heating time as in the first method of the invention. So, when the heating time is sufficiently long the aluminum-copper base alloy and the metal fibers react with one another, a metal body having a large surface area of high porosity is obtained, which body includes metal fibers entangled with one another and coated with an alloy of the first and second metals. The second method is the same as the first method as far as an aluminum or aluminum alloy as a first coating metal, metal fibers and non-oxidative atmosphere are used. However, in the second method copper or copper alloy such as copper-tin, copper-zinc, copper-nickel, copper-aluminum alloys, or the like, is used as a second coating metal.

Figure 5B:
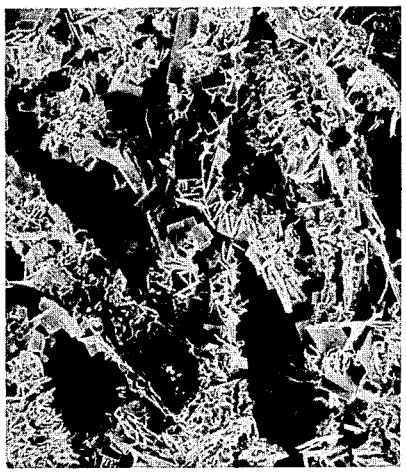

According to the second method of the invention, since the coating layers are mainly an aluminum-copper base alloy such as an alloy of aluminum and copper, or an alloy of an aluminum alloy and a copper alloy, by using first and second coating metals, the metal body can be produced at a lower heating temperature than in the first method, which uses only an aluminum or aluminum alloy as a coating metal. In addition, the wettability of the molten coating metal with the metal fibers is improved as compared with the first method. Furthermore, a metal body having an even larger surface area may be obtained, as shown in FIGS. 5*b* and *d*.

In the first and second methods of the invention, the coating metal is not necessarily in the form of a sheet, and it may be in the form of powder. The aluminum alloy and copper alloy used as coatings should contain over 50% by weight of aluminum or copper, respectively.

The metal body having a large surface area of high porosity, according to the present invention, need not necessarily be permeable throughout the entire body, i.e., the voids need not extend from the top surface to the under surface thereof. For example, a metal body having a base member may be provided such that the metal body is secured to a base member formed of aluminum or aluminum alloy. When the metal body is free of a non-permeable base member, it may present a desired permeability, so that such metal body may be used as a vaporizer, catalyst, catalyst carrier, filter, or the like. On the other hand, the metal body with a base member may be used as a heat-exchanger in addition to the aforesaid applications, such as vaporizer, catalyst and catalyst carrier.

The metal body having a large surface area and secured to the aforesaid base member should be produced according to the second method of the invention. In this case, the amount of the first coating metal should be more than the amount thereof required for the reaction with the second coating metal. Namely, the thickness of the first coating metal should be more than the thickness thereof required for such a reaction. Accordingly, one portion of the first coating metal contacting the second coating metal reacts with the second metal to form a coating over the entire surfaces of the metal fibers, but the other portion thereof not contacting the second metal remains as a base member for the metal body. In this respect, the heating temperature used should be lower than the melting point of the first coating metal, i.e., that of aluminum, or an aluminum alloy. By heating at such a temperature, only an alloy produced from aluminum and copper or from an aluminum alloy and a copper alloy, covers the metal fibers while the other portion of the first coating metal, not contacting the second coating metal, remains as a base member for the metal body.

The following embodiments are illustrative of the aforesaid features of the present invention.

EMBODIMENT 1

Figure 2:
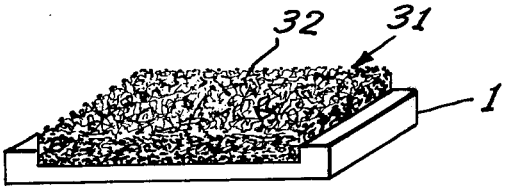

As shown in FIG. 2, a metal article, generally referenced 31 and composed of a metal body 32 having a large surface area and secured to an aluminum sheet 1, as a base member, was produced according to the aforesaid second method of the invention, in the following described manner.

As shown in FIG. 1, a copper sheet 2 of a thickness of 70 μm, as a second coating metal, was placed on a aluminum sheet 1 of a thickness of 4 mm, as a first coating metal, and then a stratum of metal fibers 3 made of stainless steel was superposed thereon. Placed above these in turn were a graphite cloth 4 and a stainless steel sheet 5. This assembly was then placed in an electric heating oven filled with a hydrogen atmosphere, and heated followed by cooling to a room temperature. The aluminum sheet 1 and copper sheet 2 served as coating metals to form the described aluminum-copper base alloy from the first and second coating metals, respectively. The stainless steel sheet 5 was used for pressing the metal fibers 3 and copper sheet 2 against the aluminum sheet 1 to obtain intimate contact, while the graphite cloth 4 was used for preventing molten aluminum-copper alloy from contact with the stainless steel sheet 5, the molten aluminum-copper alloy creeping up over the surfaces of the metal fibers due to the heating. The metal stratum of fibers 3 was first prepared by entangling stainless steel fibers of a weight of 3 g and of a diameter of 28 μm, with each other, in random directions, and sintering the stratum of metal fibers at a temperature of 1000° C for 120 minutes in hydrogen atmosphere, thereby forming the metal fibers into a sintered frame whose dimensions were 80 mm × 80 mm × 0.6 mm (thickness) and which presented a desired porosity.

The heating temperature for obtaining the metal body 32 according to the first embodiment was within the range of from 570° C to 600° C, because the eutectic temperature of an aluminum-copper alloy as a coating metal to be produced from aluminum and copper is 548° C and the melting point of aluminum is 660° C, and the heating time was 50 minutes. During the aforesaid heating, the aluminum sheet 1 reacted with the copper sheet 2 along their contacting surfaces, both of the metals being melted to provide a molten aluminum-copper alloy, formed from the whole of the copper sheet 2 and an upper portion of the aluminum sheet 1 in contact with the copper sheet 2. Then, the surfaces of the metal fibers contacting the molten aluminum-copper alloy was wetted the molten alloy creeping up over the surfaces of the metal fibers due to the wettability of the molten metal, eventually covering the whole surfaces of the fibers with the molten alloy.

Thus, the metal article 31 shown in FIG. 2 was obtained, being composed of the metal body 32 having a large surface area and an aluminum base member 1 secured to the metal body 32, and in which the stainless steel fibers of stratum 3, FIG. 1 were coated with an aluminum-copper alloy on their whole surfaces, while the lower portion of the metal body 32 was embedded in the top portion of the aluminum member 1.

Figure 5C:
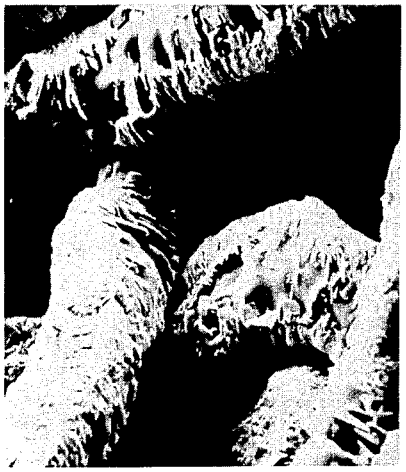

The metal body 32 was cut for obtaining the secondary electron micrographs employing an EPMA (Electron Probe Microanalyzer). FIGS. 5*a* to *d* are photographs thus obtained. As can be seen from these photographs, the metal body 32 has coatings of two types, respectively represented by FIG. 5*a* and *b*. FIGS. 5*c* and *d* are photographs obtained by further magnifying the photographs of FIGS. 5*a* and *b* by approximately three and five times, respectively. As shown in FIG. 5*a*, major surface portions of the metal fibers in the obtained metal body 32 are coated. In one type of the coating as shown in FIG. 5*a* there can be observed cracked, irregular, rough surfaces best seen in FIG. 5*c*.

Figure 5D:
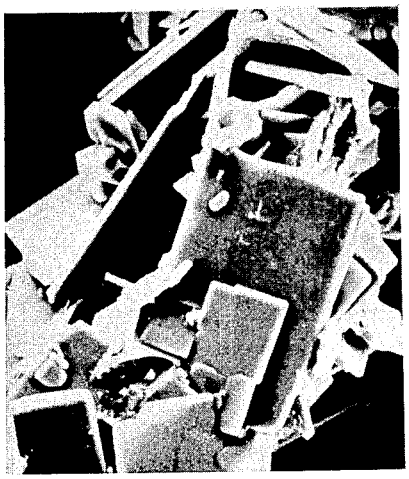

In a second type of coating as shown in FIG. 5*b*, there can be observed no metal fibers but only strips formed of a plurality of plate or flake-shaped pieces which are connected with one another in varying directions, as best seen in FIG. 5*d*. In other words, the coating shown in FIG. 5*b* is composed of a plurality of flakes, plates or chips. It is evident from FIGS. 5*a* to *d*, that the coating layers of the metal body have varying surface structures which present an enormously large surface area. The coated metal fibers contact one another at a number of points in such a manner that a number of voids are defined therebetween, presenting a desired porosity. The measured porosity obtained was proved to be about 65%. As is clear from the foregoing, the coating layers of the obtained metal body 32 may be roughly classified into two types. The difference in such types is due to the following reasons.

FIGS. 5*a* and *c* show the metal fibers coated with essentially an aluminum-copper alloy and formed in such a manner that the molten aluminum-copper alloy creeps up over the entire surfaces of the metal fibers. FIGS. 5*b* and *d* show a condition wherein the atoms in the stainless steel fibers, wetted with the molten aluminum-copper alloy, are diffused into the molten aluminum-copper alloy to form another alloy including steel, aluminum and copper which has been precipitated on the surfaces of the coating as plate or flake-shaped crystals. As a matter of fact, analysis of the coating layers of FIGS. 5*a* and *c* according to the EPMA showed that the coating layers were mainly aluminum-copper alloy with very little iron and nickel from the metal fibers. In contrast thereto, the flake or plate-shaped pieces shown in FIGS. 5*b* and *d* contained from 45 to 54%, by weight, of aluminum, from 31 to 35% copper, from 11 to 13% iron and a small amount of nickel and chromium. This indicates that the elements contained in the metal fibers have been diffused into the aluminum-copper alloy.

Apparently, such a difference in the composition of the coating is due to the difference in contacting time of the molten aluminum-copper alloy with the metal fibers. The difference in the contacting time is dependent on the varying distances between the metal fibers 3 and the copper plate 2 as well as on the surface condition of the metal fibers, which control the varying times at which the molten alloy reaches various points on the metal fibers. Thus, for obtaining the surface condition shown in FIGS. 5*b* and *d*, it is required that the heating time be long enough for forming the aforesaid alloy.

In addition to the described two types of coatings, the metal body 32 may partly exhibit an intermediate state between the two types of surface structures represented by FIGS. 5*a*, *c* and FIGS. 5*b* and *d*, respectively, i.e., coating layers which contain a small amount of flakes or plate-shaped pieces. The diameters of such metal fibers were found to be slightly smaller than those of the metal fibers in their initial condition.

EMBODIMENT 2

Figure 3:
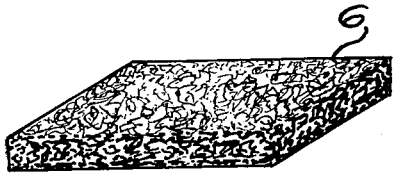
FIGS. 3 and 4 are a perspective view and a fragmentary perspective view of fabricated metal bodies having large surface areas, which have been prepared by the second and third embodiments according to the present invention, respectively.

A metal body 6 not having a base sheet, as shown in FIG. 3, was prepared according to the first method of the invention.

More particularly, a stratum 6 of stainless steel metal fibers similar to stratum 3 of the first embodiment was placed on an aluminum sheet of thickness of 0.6 mm, which served as a coating metal, and covered with a graphite cloth and a stainless steel sheet similar to parts 4 and 5 of FIG. 1. This assembly was heated in the same manner as in the first embodiment and followed by cooling. The aforesaid heating was effected at a temperature of 700° C which was not lower than the melting point of aluminum for 40 minutes. During the heating step, the aluminum sheet was melted and the molten aluminum crept up over the surfaces of those metal fibers contacting the molten aluminum to eventually cover the entire surfaces of the metal fibers by reason of wettability.

Thus, metal body 6 having a large surface area and high porosity as shown in FIG. 3, was obtained. The metal body 6 includes stainless steel fibers as a frame thereof, and the metal fibers are coated with aluminum. The coated body presents surface structures similar to those shown in FIGS. 5*a* and *c*. In addition, the coated body included a small portion of surface having flakes similar to those shown in FIGS. 5*b* and *d*. The porosity of the metal body 6 was found to be about 70%.

EMBODIMENT 3

Figure 4:
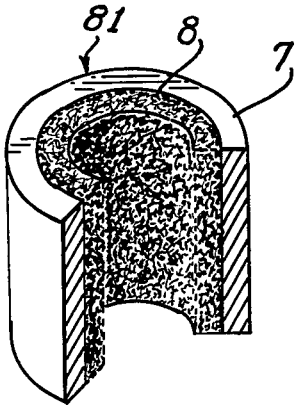

A tubular metal article 81 composed of a metal body 8 having a large surface area and an aluminum tube 7 as a base member, as shown in FIG. 4, was obtained according to the second method of the invention. The product included metal body 8 fitted into and integrally secured to the alumium tube 7 which served as a base member for the body 8.

In this process, a copper sheet, not shown, of a thickness of 70 μm was placed over the inner wall of an aluminum tube 7 having an inner diameter of 44 mm and an outer diameter of 50 mm so as to contact the inner wall of the aluminum tube and form a copper cylinder. Then, a stratum of metal fibers 8 of tubular form, which had an inner diameter of 43 mm and an outer diameter of 44 mm was fitted into the copper cylinder. This assembly was heated to a temperature of 590° C for 50 minutes in a hydrogen atmosphere, followed by cooling to room temperature. Due to the heating, a molten aluminum-copper alloy clung to the surfaces of the metal fibers, forming the metal body 81 having a large surface area as shown in FIG. 4. The obtained tubular metal article included an inner tubular metal body 8 consisting essentially of metal fibers coated with an aluminum-copper alloy produced by the reaction of copper from the copper sheet and aluminum from the inner wall portion of the aluminum tube, and an outer aluminum tube 7 integrally fixed to the outer wall of the tubular metal body 8. In this respect, the metal tubular body 8 having a large surface area had coatings similar to those of metal body 6, which was produced as described in the second embodiment according to the present invention. The porosity of the metal body 8 was found to be about 70%.

In metal bodies produced according to the aforesaid embodiments, the surfaces of the metal fibers are coated with metal and have extremely complex, cracked, irregular surfaces including flake or plate-shaped metal pieces projecting from the surfaces of the coating, so that the bodies provide extremely rough surfaces. Since the fibers are entangled a desired porosity for the body can be obtained, as well as an extremely large surface area. Thus, a liquid such as gasoline will be instantaneously absorbed into the voids of the rough surfaces of the metal body. The metal body provides excellent heat conductivity, because it consists essentially of metal fibers coated with aluminum or aluminum-copper alloy. Accordingly, the metal body is well suited for use as a vaporizer for gasoline or other liquids. Because of the large surface area and desired high porosity, which allows the passage of a fluid therethrough with minimum flow resistance, the metal body may be used as a heating exchange element, in addition to applications as a catalyst, a catalyst carrier, or a filter.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. A coated bed or stratum of entangled metal fibers wherein the coated bed has a large surface area and high porosity, the coated bed comprising:

a. a coating of metal selected from the group consisting of aluminum and aluminum alloy and b. fibers of metal which has a higher melting point than that of the coating, the coating having rough and complex surfaces with a plurality of spaces, cracks, irregularities and flake or plate-shaped portions, and the metal fibers being coated over their entire surfaces with said coating.

2. A coated bed according to claim 1 wherein the coating consists essentially of a material selected from the group consisting of aluminum and aluminum alloy.

3. A coated bed according to claim 2, wherein said metal fibers are of a material selected from the group consisting of iron and iron alloy.

4. A coated bed according to claim 2, wherein said iron alloy is iron-chromium or stainless steel.

5. A coated bed according to claim 2, wherein said metal fibers are tungsten fibers.

6. A coated bed according to claim 2, wherein said metal fibers are molybdenum fibers.

7. A coated bed according to claim 2, wherein the diameters of the metal fibers range between 20 and 500 microns.

8. A coated bed according to claim 2, wherein said aluminum alloy contains more than 50% by weight of aluminum.

9. A coated bed according to claim 2, wherein said aluminum alloy is an alloy selected from the group consisting of aluminum-copper, aluminum-manganese and aluminum-silicon.

10. A coated bed according to claim 2, wherein both metals of said fibers and the fiber coating are alloyed along the boundaries thereof.

11. A coated bed according to claim 2, wherein said coated bed is secured to a base member of a material selected from the group consisting of aluminum and aluminum alloy.

12. A coated bed according to claim 11, wherein said base member is of plate shape.

13. A coated bed according to claim 11, wherein said base member is of tubular shape.

14. A gasoline vaporizer having a coated bed according to claim 2.

15. A catalyst carrier having a coated bed according to claim 2.

16. A heat exchanger having a coated bed according to claim 2.

17. A filter having a coated bed according to claim 2.

* * * * *